US005217385A

United States Patent [19]

Inoue et al.

[11] Patent Number: 5,217,385

[45] Date of Patent: Jun. 8, 1993

[54] CONNECTOR

[75] Inventors: Nori Inoue; Masamitsu Chishima, both of Mie, Japan

[73] Assignee: Sumitomo Wiring Systems, Ltd., Mie, Japan

[21] Appl. No.: 756,252

[22] Filed: Sep. 6, 1991

[30] Foreign Application Priority Data

Sep. 14, 1990 [JP] Japan ..... 2-97101[U]

[51] Int. Cl.[5] ..... H01R 13/627

[52] U.S. Cl. ..... 439/353; 439/489

[58] Field of Search ..... 439/188, 345, 347, 350, 439/351, 352, 353, 357, 358, 488, 489

[56] References Cited

U.S. PATENT DOCUMENTS

| | | | |
|---|---|---|---|
| 3,611,261 | 10/1971 | Gregory | 439/353 |
| 4,634,204 | 1/1987 | Detter et al. . | |
| 4,915,648 | 4/1990 | Takase et al. | 439/353 X |
| 4,946,404 | 8/1990 | Takenouchi et al. | 439/352 |
| 4,993,967 | 2/1991 | Matsumoto | 439/352 X |
| 5,026,298 | 6/1991 | Brussalis et al. | 439/352 X |
| 5,041,017 | 8/1991 | Nakazato et al. | 439/352 X |

FOREIGN PATENT DOCUMENTS 1462812 1/1977 United Kingdom .

*Primary Examiner*—Larry I. Schwartz

*Assistant Examiner*—Khiem Nguyen

*Attorney, Agent, or Firm*—Sughrue, Mion, Zinn, Macpeak & Seas

[57] ABSTRACT

A connector with a locking mechanism includes a pair of connector housings coupled with each other at their opposed portions. The locking mechanism locks the coupled position of the housings and has a pair of locking devices formed in the housings. One of the connector housings has a slide member having one of the locking devices and a housing body having a slide groove in an upper center portion thereof for slidably receiving the slide member. The slide member is biased by a biasing spring disposed between the slide member and the housing body so that the slide member can move away from the coupled position. The slide member is adapted to be maintained in a first locking position in the housing body by a latching device. The slide member is adapted to be maintained in a second locking position in the one of the connector housings by the locking mechanism to prevent the slide member and the housing body from disengaging from the coupled position. The slide member may also be provided with a conductive portion positioned so as to engage a pair of detecting terminals coupled to detecting conductors when the slide member is moved from the first locking position to the second locking position whereby a circuit for detecting the complete coupling is formed.

10 Claims, 8 Drawing Sheets

CONNECTOR

BACKGROUND OF THE INVENTION

1. Field of the Invention

This invention relates to a connector which couples a female connector housing and a male connector housing so as to electrically connect their terminals with each other, and more particularly to a connector provided with a mechanism for detecting if the female and male connector housings are properly coupled with each other.

2. Description of the Related Art

In a connecting device for male and female connector housings, if the housings are not properly coupled, a locking mechanism cannot be locked in a mating position. However, a connector in an incomplete coupling may pass a conductivity test so long as the terminals of the housings are in contact with each other. If such a connector in is attached to a car without correcting the incomplete coupling, the contact between the terminals is likely to be interrupted due to vibration of a car body thus causing poor conductivity.

Japanese Utility Model Public Disclosure No. 99381/1986 discloses a connector which overcomes the above drawback. This known connector includes an elastic member mounted on either one of the female and male connector housings to generate an elastic reaction force in the direction opposite to the coupling direction. When the connector housings are in a state of incomplete coupling, the elastic reaction force disconnects the incompletely coupled connector housings to indicate incomplete coupling.

The above connector has a construction in which the elastic member is mounted between locking portions formed integrally with each of the female and male connector housings respectively. Consequently, there is a contact resistance between the terminals, when they contact with each other in a state of incomplete coupling of the housings, that is, the terminals are in contact with each other at over their partial areas. A relatively high reaction force for the elastic member is required to disconnect the incompletely coupled connector housings. However, the higher the elastic reaction force of the elastic member becomes, the greater the resistance force of coupling of the connector housings becomes, thus making coupling difficult. Consequently, the connector housings may not be completely coupled to each other.

SUMMARY OF THE INVENTION

An object of the present invention is to provide a connector having a mechanism for detecting incomplete coupling.

Another object of the present invention is to provide a connector having a detecting mechanism which does not prevent coupling between the connector housings.

In order to achieve the above objects, a connector in accordance with the present invention includes a pair of connector housings coupled with each other at their opposed portions. The connector is provided with a locking mechanism to lock the housings in a coupled position. The locking mechanism has a pair of locking means formed in the housings in opposition to each other. One of the connector housings has a slide member which includes one of said locking means and a housing body with a slide groove in an upper center portion thereof for slidably receiving the slide member.

The slide member is biased by a biasing spring disposed between the slide member and the housing body so that the slide member can move away from a coupled position. The slide member is adapted to be maintained in a first locking position in the housing body by a latching means to prevent the slide member from moving away from a coupled position. The slide member is adapted to be maintained in a second locking position in the connector housing by the locking mechanism to prevent the slide member and said housing body from moving away from said coupled position.

The latching means may have a locking piece with a pawl provided on each side of the slide member and a slot with a shoulder portion formed in the housing body.

The pair of locking means may be a locking piece with an opening formed on the upper portion of the slide member and a locking piece with a pawl provided on the upper portion of the other housing.

The pair of locking means may be a locking piece with a pawl provided on the upper portion of the slide member and a locking piece with an opening formed on the upper portion of the other housing.

The rear end of said slide member in the first locking position may project from the rear end face of the housing body.

The slide member may be provided with a conductive portion at the bottom thereof and the conductive portion can engage a pair of detecting terminals coupled to detecting cords when the slide member is moved from the first locking position to the second locking position whereby a circuit for detecting complete coupling is formed in said detecting cords.

When the slide member is pushed towards to the second locking position after the pair of connector housings are coupled with each other in the proper or normal coupling position, the locking means of the slide member engage the locking means of the opposite housing to lock the connector housings in the normal coupling position.

When the pair of connector housings are incompletely coupled with each other, even if the slide member is pushed into the second locking position, the locking piece of the slide member is moved away from the locking piece of the opposite housing to cause poor locking and the slide member is then returned to the first locking position. This process makes the incomplete coupling obvious an easily detected.

A biasing force required to return the slide member is relatively low and the operation for pushing the slide member into the housing body becomes easier, since the spring biases only the slide member and there is no pressure against the slide member between terminals contacted with each other. This returning force does not affect a force necessary for inserting and coupling the connector housings.

In addition, a detecting circuit is formed in the detecting cords drawn out of the connector to generate a signal which detects the coupling of the housings when the slide member reaches the second locking position. Consequently, it is possible to detect whether a coupling condition in the connector is complete or not at any position remote from the connector.

DETAILED DESCRIPTION OF THE PREFERRED EMBODIMENTS

Referring now to FIGS. 1 to 9, a first embodiment of a connector in accordance with the present invention will be explained below.

Figure 1:
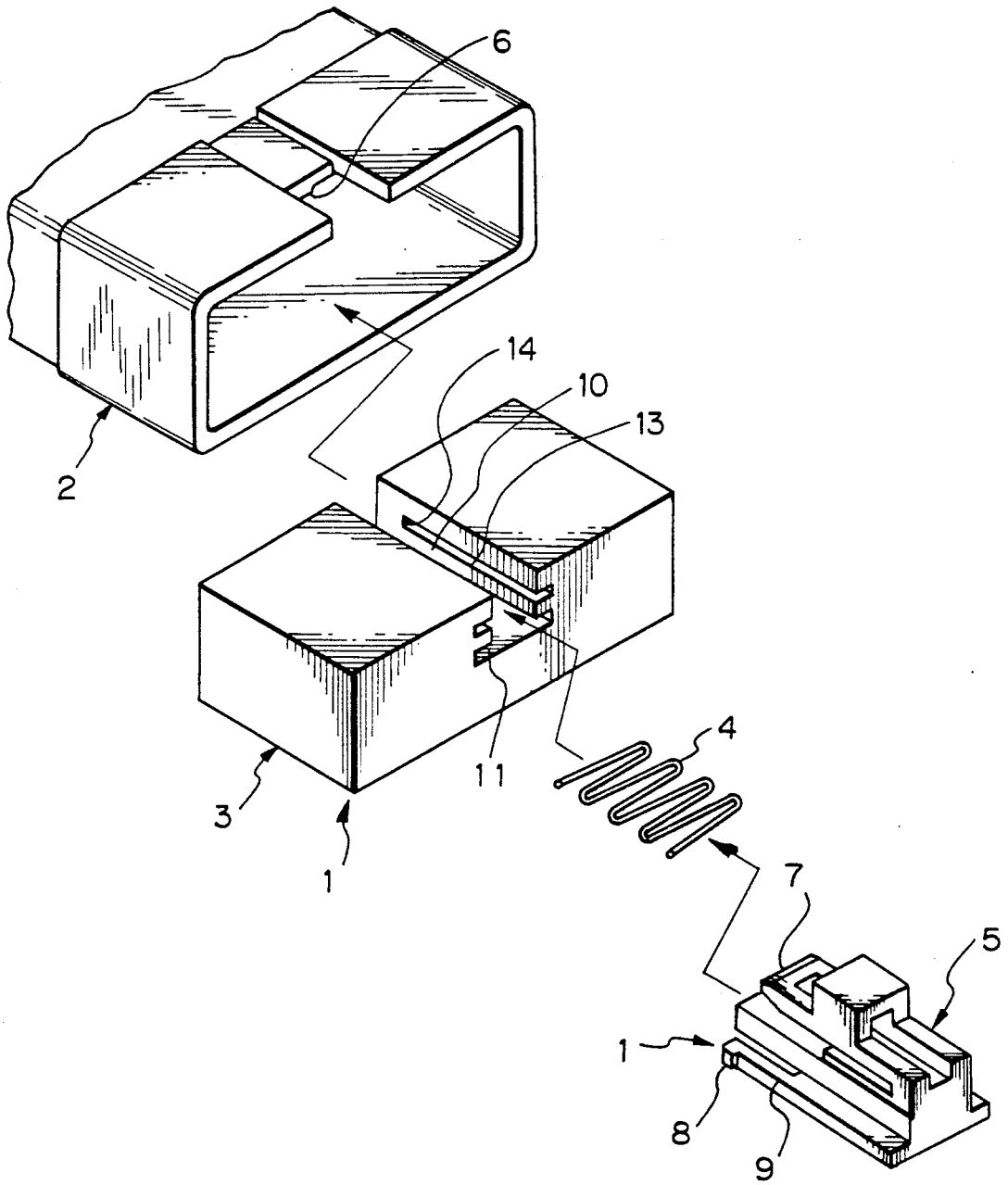
FIG. 1 is an exploded perspective view of a connector of a first embodiment in accordance with the present invention.
Figure 2:
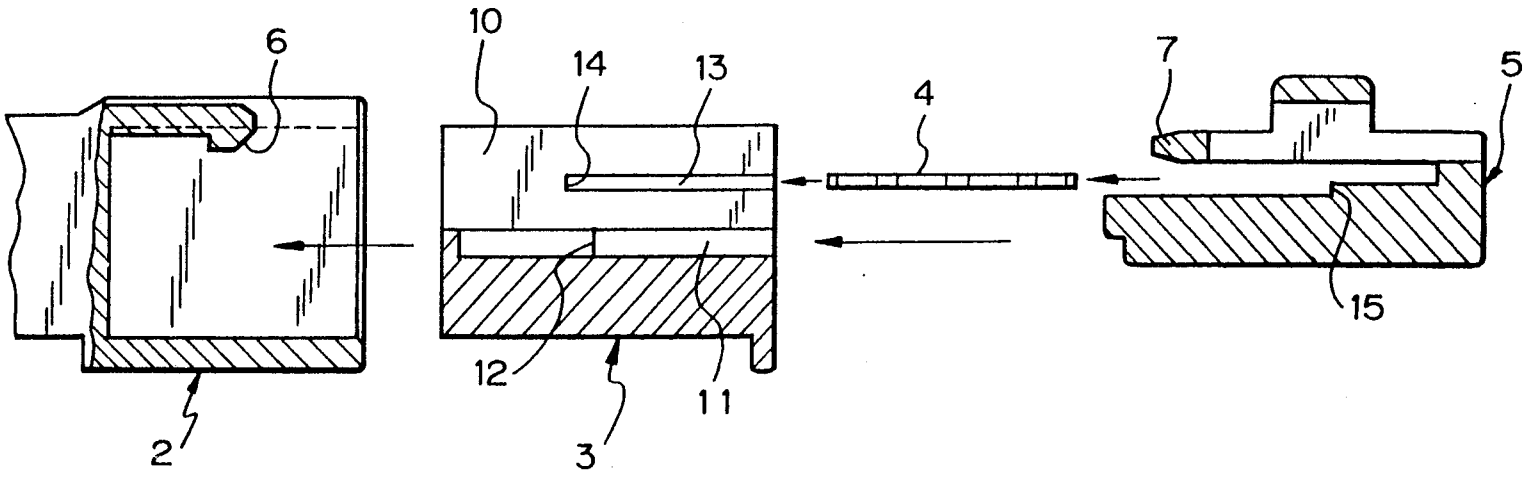
FIG. 2 is an exploded longitudinal cross-sectional view of the connector shown in FIG. 1.
Figure 3:
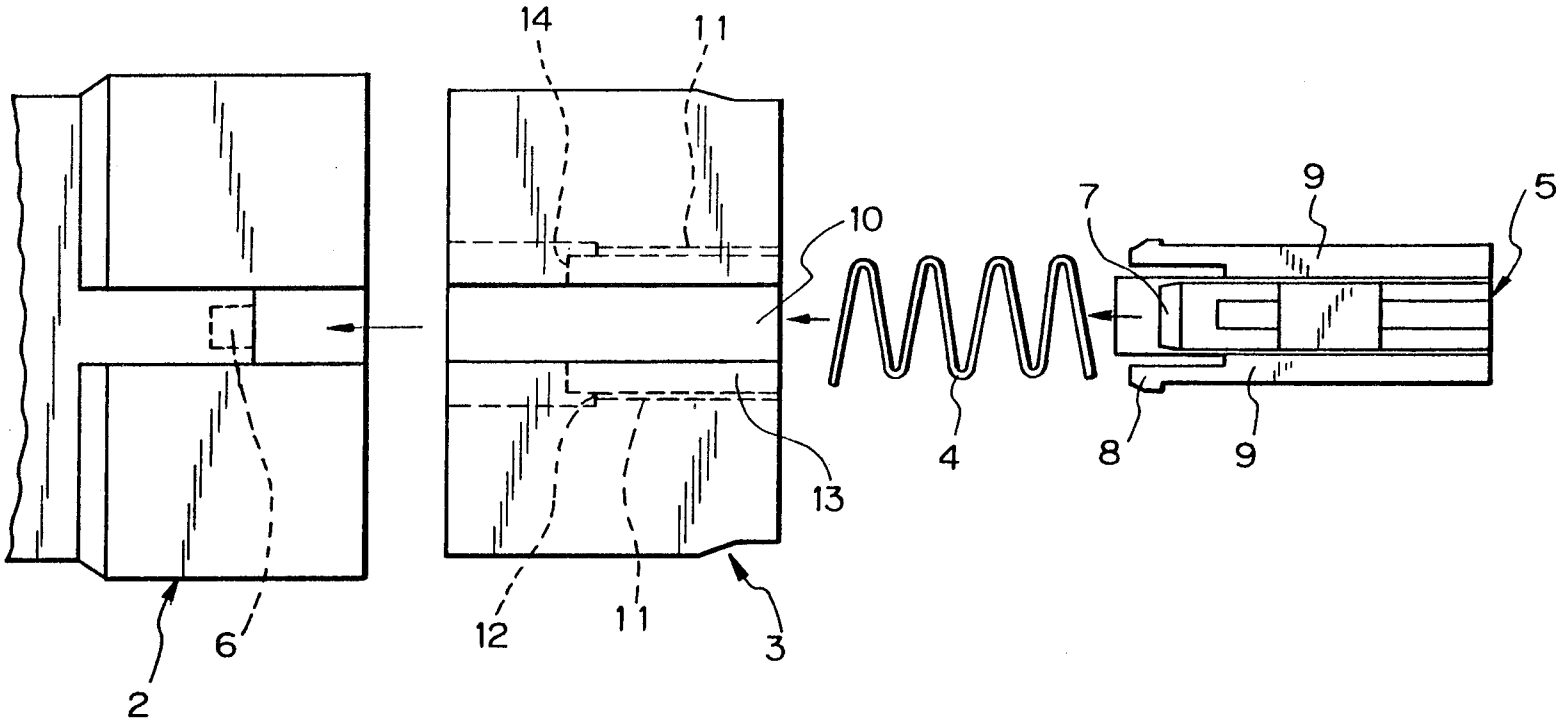
FIG. 3 is a top view of FIG. 2.

As shown in FIGS. 1 to 3, a connector provided with a locking mechanism includes a female connector housing (hereinafter merely referred to as a female housing) 1 and a male connector housing (hereinafter merely referred to as a male housing) 2. A pair of female and male housings 1 and 2 are coupled with each other at their opposite portions to electrically connect terminals (not shown) mounted in the housings 1 and 2. A locking piece 6 with a pawl is provided on the upper center portion of the male housing 2 and mutually engages a locking piece 7 with an opening formed on the upper center portion of the female housing 1 to lock the normal coupling position of the housings 1 and 2. The locking pieces 6 and 7 constitute the locking mechanism for the housings 1 and 2.

The female housing 1 has a housing body 3 and a slide member 5 slidably mounted in the upper center portion of the housing body 3 in such a manner that the locking piece 7 is directed to the male housing 2. A compression or biasing spring 4 is disposed between the housing body 3 and the slide member 5 to bias the slide member 5 in the direction opposite to the coupling direction of the housings.

Further, the slide member 5 is in the form of a block having a locking piece at the top and a latching piece 9 with a pawl 8 at the lower opposite sides. The housing body 3 is provided with a U-shaped slide groove 10 at the upper center portion. The slide member 5 is inserted into the groove 10 from the rear end thereof and carried slidably in the groove.

The slide groove 10 is provided with a slot 11 formed in opposite side walls thereof and extending along the bottom of the groove 10 to an intermediate portion of the groove to receive the latching piece 9 of the slide member 5. The end of the slot 11 defines a latching wall or shoulder 12 which engages the pawl 8 of the latching piece 9. The pawl 8 of the latching piece 9 and the shoulder 12 of the slot 11 constitute the latching means. The slide groove 10 is also provided with a slot 13 at the opposite side walls thereof above the slot 11 to receive the biasing spring at the opposite sides. The end of the slot 13 defines a stop portion 14.

Figure 4:
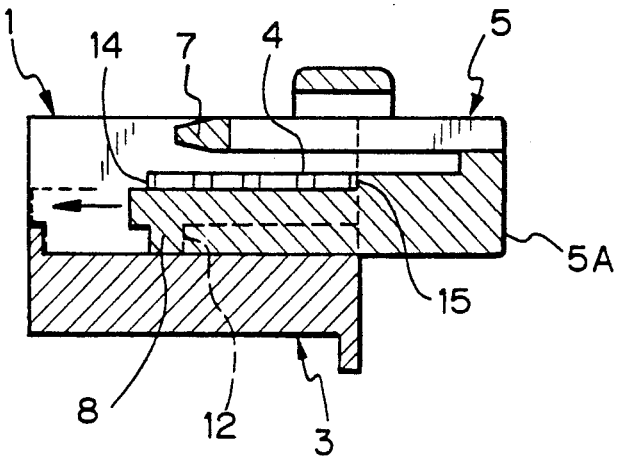
FIG. 4 is a longitudinal cross-sectional view of a female connector housing showing an assembled position thereof.
Figure 5:
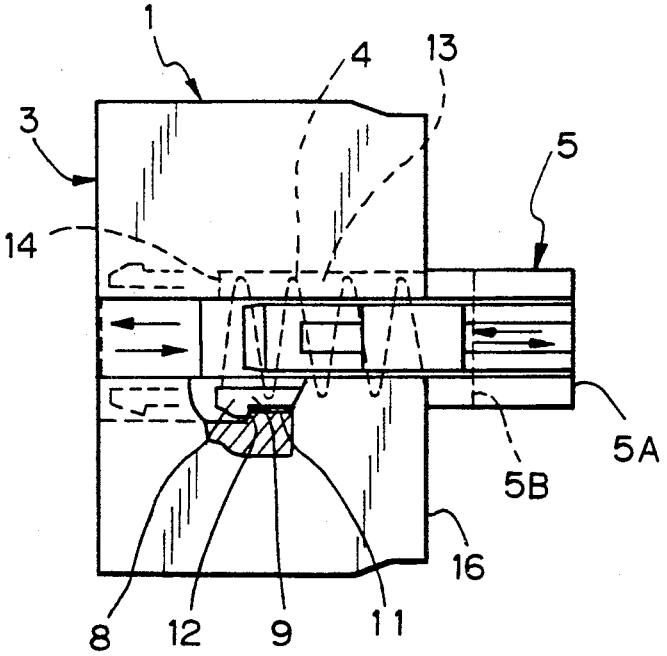
FIG. 5 is a top view of FIG. 4.

The biasing spring 4 is of a thin zigzag flat form suitable for being received in the slot 13 under a compressed condition. As shown in FIGS. 4 and 5, the compression spring 4 is inserted into the slot 13 with the opposite sides of the spring 4 contacting the slot 13. Then the slide member 5 is inserted into the groove 10 with the slide member 5 pushing the rear end of the spring 4. The pawl 8 of the latching piece 9 engages the latching shoulder 12 in the forward end of the slot 11. Thus, the compression spring 4 is disposed between the forward stop end 14 in the housing body 3 and a backward end stop 15 in the slide member 5 in the compressed condition. The slide member 5 is locked at the first locking position 5A while the compression spring acts to return the slide member 5 in a direction opposite to the coupling direction. The first locking position 5A is a position where the rear end of the slide member 5 projects from a rear face or wall 16 of the housing body 3.

The slide member 5 can be moved forwardly against the biasing force of the spring 4 by pushing the rear end of the member by fingers from the first locking position 5A to a second locking position 5B where the locking piece 7 normally engages the locking piece 6, as shown by a broken line in FIG. 5. The female housing 1 is formed by a combination of the housing body 3 and the slide member 5. The female housing 1 is coupled mutually to the male housing 2.

Figure 6:
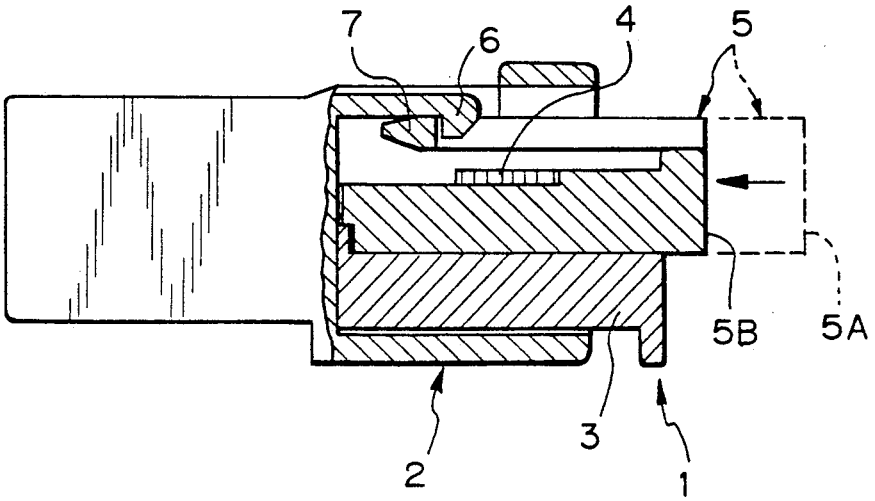
FIG. 6 is a longitudinal cross-sectional view of the connector shown in FIG. 2, illustrating a proper position thereof.
Figure 7:
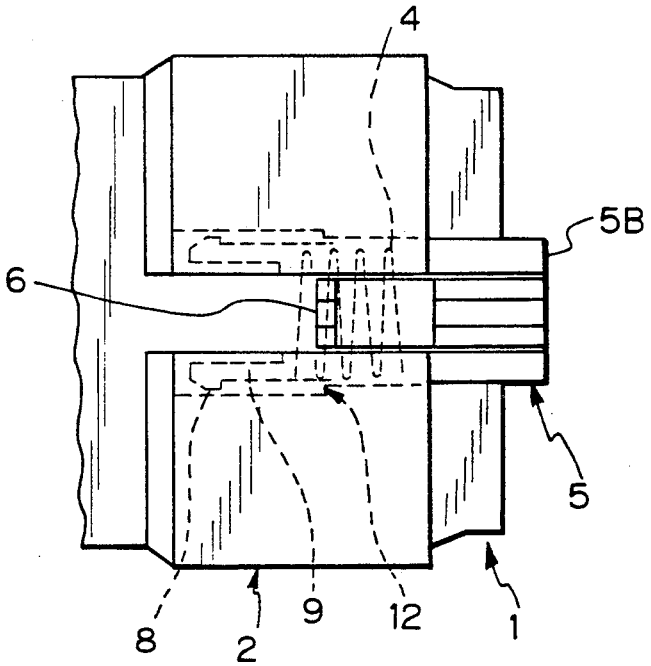
FIG. 7 is a top view of FIG. 6.

In the first embodiment of the connector described above, after the female and male housings 1 and 2 have been coupled with each other, the slide member 5 at the first locking position 5A is advanced to the second locking position 5B shown in FIGS. 6 and 7 against the compression force of the spring 4 when the slide member 5 is manually pushed forward. Then, the female and male housings 1 and 2 are locked into a coupled position by engagement of the locking pieces 6 and 7 of the locking mechanism.

Figure 8:
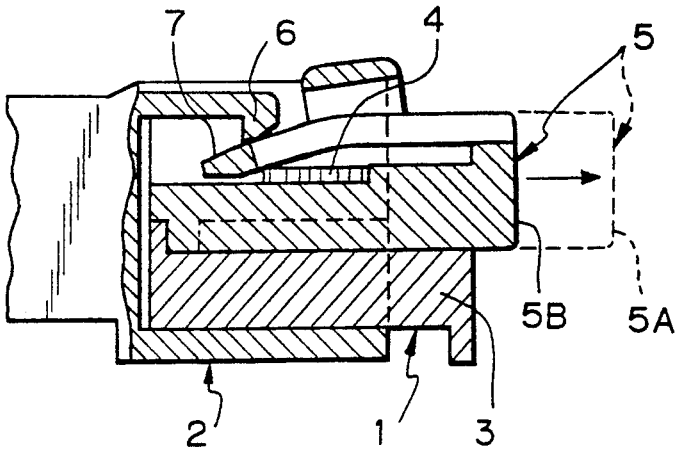
FIG. 8 is a longitudinal cross-sectional view of the connector shown in FIG. 2, illustrating an abnormally assembled position.
Figure 9:
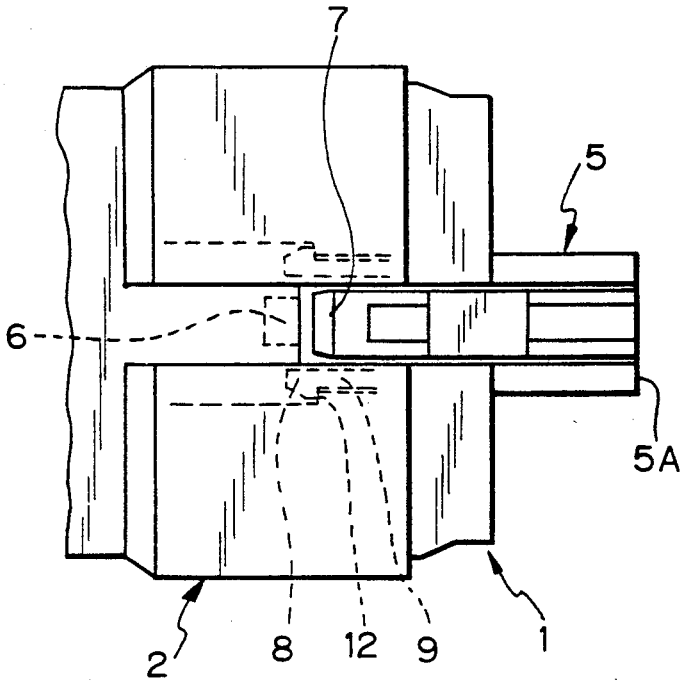
FIG. 9 is a top view of FIG. 8.

When the amount of coupling between the female and male housings 1 and 2 is insufficient as shown in FIGS. 8 and 9, the locking piece 7 of the slide member 5, when pushed to the second locking position 5B, cannot engage with the locking piece 6, and thus a deficient locking results. The slide member 5 is immediately returned to the first locking position 5A by the compression force of the biasing spring 4 and the rear end of the slide member 5 projects from the housing body 3. Such projection of the slide member 5 clearly indicates a coupling failure.

The first embodiment shown in FIG. 1 adopts a construction in which the rear end of the slide member 5 at the first locking position 5A projects from the rear wall 16 of the housing body 3 in order to clearly detect a coupling failure. However, the present invention is not limited to this arrangement. It is preferable to construct the connector to detect a change between the first locking position 5A and the second locking position 5B either visually or tactually.

Figure 10:
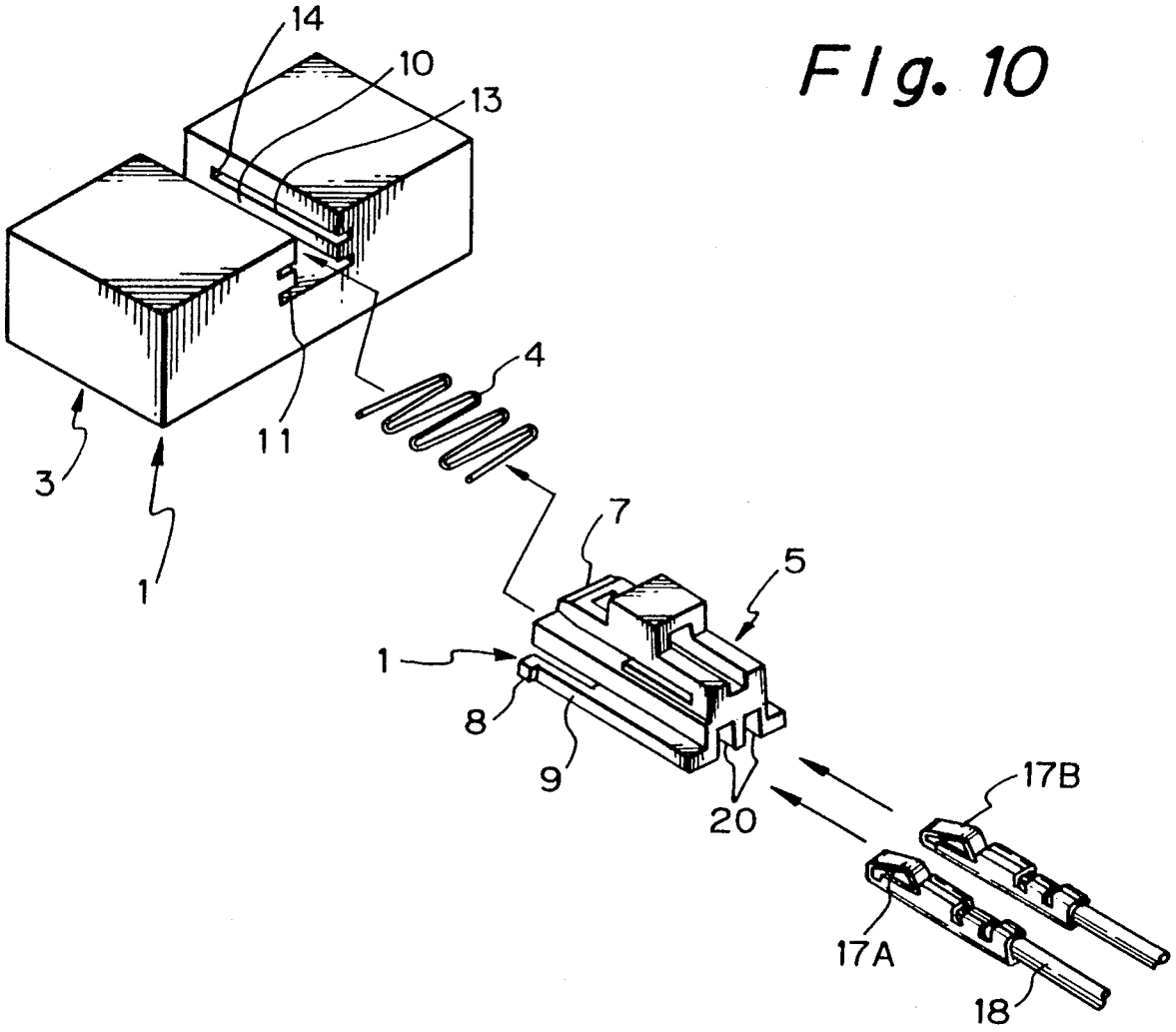
FIG. 10 is an exploded perspective view of a connector of a second embodiment in accordance with the present invention.
Figure 11:
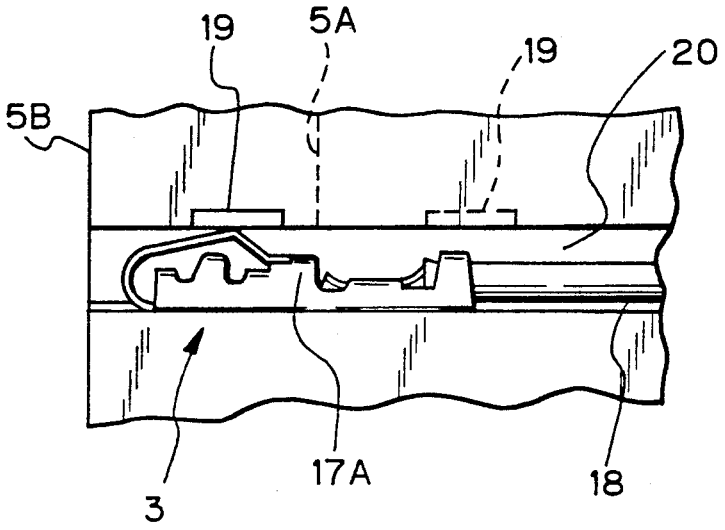
FIG. 11 is a side view of a detecting terminal.
Figure 12:
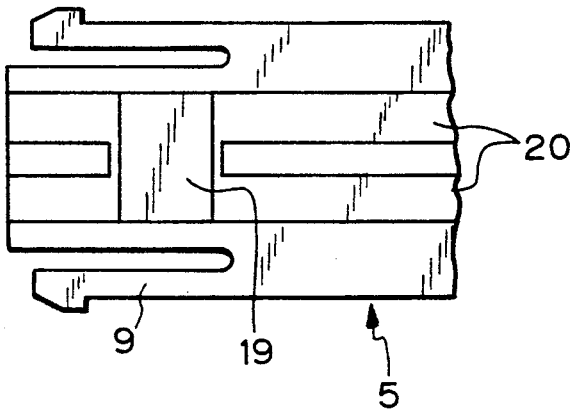
FIG. 12 is a bottom view of a slide member.

Referring now to FIGS. 10 to 12, a second embodiment of a connector in accordance with the present invention is described below. The connector shown in FIG. 10 is similar to that shown in FIG. 1 and has the female housing 1 including the housing body 3, the compression spring 4, and the slide member 5. The slide member 5 is provided with two slots 20 for receiving terminals 17A and 17B, at the bottom thereof. The terminals 17A and 17B are secured to the bottom of the groove 10 in the housing body 3 so that their contacts can engage the bottoms of the slots 20 in the slide member 5. As shown in FIGS. 11 and 12, the slots 20 are provided with respective conductors 19 at the bottoms. In FIG. 11, when the slide member 5 is moved from the first locking position 5A to the second locking position 5B, the conductors 19 contact with the terminals 17A and 17B to form a detecting circuit in the conductors 18.

In this embodiment, when the slide member 5 reaches the second locking position 5B, a detecting current flows in the conductor 18 to transmit a conducting signal to any place remote from the connector. Accordingly, it is possible to exactly detect proper coupling of the housings at a place remote from the connector. Even if the slide member 5 reaches the second locking position 5B when coupling of the housings is incomplete, the slide member 5 is immediately returned to the first locking position 5A to switch off the detecting signal. This enables a failure of coupling to be identified.

The present invention is not limited to the embodiments described above. The slide member 5 may be provided with the locking piece 6 with a pawl while the other housing 2 may be provided with the locking piece 7 with an opening.

It will be apparent from the foregoing description that the mechanism for detecting the complete and incomplete couplings in the connector of the present invention is not subject to the contacting pressure between the connected terminals if the amount of coupling is insufficient. Accordingly, there is no error in detecting a coupling failure in the connector since it can be precisely detected either visually or tactually. It is possible to prevent the failure of coupling in the connector beforehand with a high degree of reliability. The detecting mechanism does not result in an increase in a force required for coupling the connector housings.

Further, the connector of the second embodiment is most suitable for a car connector which is used in a space where it is difficult to detect incomplete coupling visually or tactually, since it is possible to detect the condition of coupling in the connector at a place remote from the connector.

What is claimed is:

1. A connector including a pair of connector housings adapted to be coupled with each other at opposed portions thereof, said connector being provided with a locking mechanism to lock said housings in a coupled position, said locking mechanism having first and second locking devices formed oppositely in each of said housings, respectively, one of said connector housings comprising a slide member having said first locking device formed thereon and a housing body having a slide groove formed in an upper center portion thereof for slidably receiving said slide member;

said slide member being biased by a biasing spring disposed between said slide member and said housing body so that said slide member is biased in a direction away from said second locking mechanism;

a latching device coupled to said slide member and said one connector housing so as to maintain said slide member in a first position in said housing body wherein said connector housings are slidable with respect to each other;

said slide member being adapted to be maintained in a second position in said one connector housing by said locking mechanism when said slider is moved to a position wherein said first and second locking devices are engaged with each other so as to maintain said slide member and said housing body in said coupled position.

2. A connector according to claim 1, wherein said latching device comprise a latching piece with a pawl provided on each side of said slide member and a slot with a shoulder portion formed in said housing body.

3. A connector according to claim 1, wherein said locking devices comprise a locking piece with an opening formed on the upper portion of said slide member and a locking piece with a pawl provided on the upper portion of the other of said connector housings.

4. A connector according to claim 1, wherein said locking devices comprise a locking piece with a pawl provided on an upper portion of said slide member and a locking piece with an opening formed on the upper portion of the other of said connector housings.

5. A connector according to claim 1, wherein a rear portion of said slide member projects from the rear end face of said housing body when said slide member is in said first position.

6. A connector according to claim 1, wherein said slide member is provided with a conductive portion and wherein said conductive portion is positioned so as to engage a pair of detecting terminals coupled to detecting conductors when said slide member is moved from said first position to said second position whereby a circuit for detecting the complete coupling is formed in said detecting conductors.

7. A connector according to claim 6, wherein said latching device comprises a latching piece with a pawl provided on each side of said slide member and a slot with a shoulder portion formed in said housings body.

8. A connector according to claim 6, wherein said locking devices comprise a locking piece with an opening formed on an upper portion of said slide member and a locking piece with a pawl provided on an upper portion of the other of said connector housings.

9. A connector according to claim 6, wherein said pair of locking means comprises a locking piece with a pawl provided on an upper portion of said slide member and a locking piece with an opening formed on the upper portion of the other of said connector housings.

10. A connector according to claim 6, wherein a rear portion of said slide member projects from the rear end face of said housing body when said slide member is in said first position.

* * * * *